United States Patent [19]

Arnold et al.

[11] Patent Number: 4,572,126

[45] Date of Patent: Feb. 25, 1986

[54] APPARATUS FOR CONTROLLING THE OVERRUN MODE OF OPERATION OF AN INTERNAL COMBUSTION ENGINE

[75] Inventors: Herbert Arnold, Eberdingen; Heinz Hofer, Weissach; Michael Horbelt, Schwieberdingen, all of Fed. Rep. of Germany

[73] Assignee: Robert Bosch GmbH, Stuttgart, Fed. Rep. of Germany

[21] Appl. No.: 661,805

[22] Filed: Oct. 17, 1984

[30] Foreign Application Priority Data

Oct. 18, 1983 [DE] Fed. Rep. of Germany ..... 3337786

[51] Int. Cl.[4] ..... F02D 5/02

[52] U.S. Cl. ..... 123/325; 123/333

[58] Field of Search ..... 123/320, 325, 326, 332, 123/333

[56] References Cited

U.S. PATENT DOCUMENTS 4,186,691 2/1980 Takase et al. ..... 123/325
4,192,279 3/1980 Maisch et al. ..... 123/333
4,416,230 11/1983 Katayose et al. ..... 123/333
4,440,127 4/1984 Virgilio ..... 123/325

*Primary Examiner*—William A. Cuchlinski, Jr.
*Attorney, Agent, or Firm*—Walter Ottesen

[57] ABSTRACT

The invention is directed to an apparatus for controlling the overrun mode of operation of an internal combustion engine in dependence on the instantaneous rotational speed and a threshold characteristic of a resume speed. A throttle valve position sensor, a speed comparator and an evaluation circuit for determining a fuel supply cutoff or a fuel metering signal are provided. Means responsive to engine speed or actuable at the operator's discretion permit the circuit to be held in a state in which the overrun cutoff signals are suppressed. If these means are speed-dependent, a dynamic suppression for a predetermined period of time results; the means utilized for suppressing the overrun cutoff function may also be actuated in response to external driving situations or in response to the conditions of other components of the vehicle.

11 Claims, 1 Drawing Figure

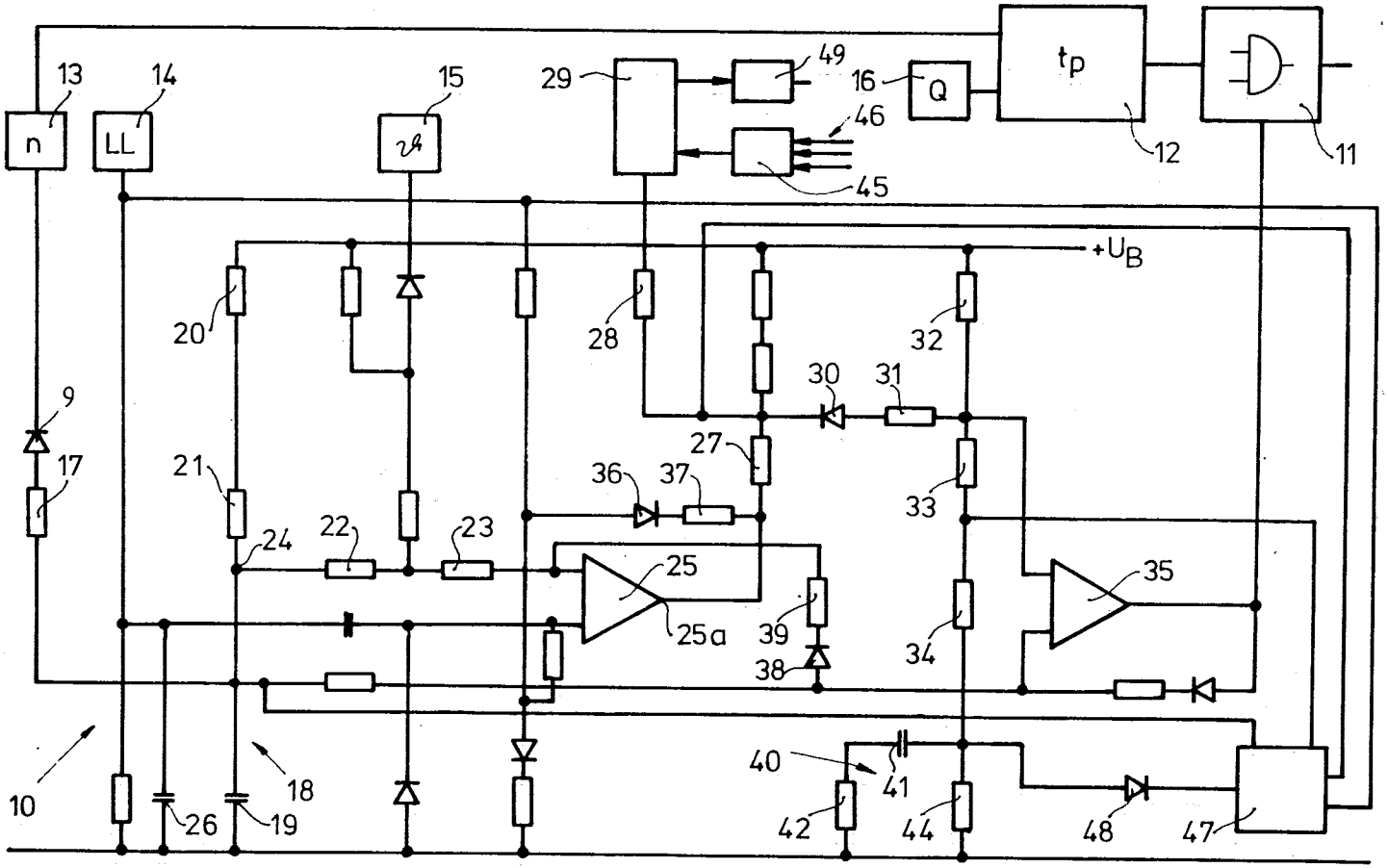
11
12
$t_p$
Q
16
46
45
49
29
15
14
LL
13
n
9
17
10
$+U_B$
32
31
30
33
34
35
27
37
36
28
25
25a
39
38
40
41
42
44
47
48
23
22
24
20
21
18
19
26

APPARATUS FOR CONTROLLING THE OVERRUN MODE OF OPERATION OF AN INTERNAL COMBUSTION ENGINE

FIELD OF THE INVENTION

The invention relates to an apparatus for controlling the overrun mode of operation of an internal combustion engine in dependence upon the instantaneous rotational speed and a resume-speed threshold characteristic.

BACKGROUND OF THE INVENTION

In the operation of an internal combustion engine, it is known to interrupt the supply of fuel when the throttle valve is closed at high engine speeds, that is, when the internal combustion engine is in the overrun mode of operation. However, an overrun condition exists also if the engine speed of an internal combustion engine is higher than that corresponding to the throttle position in a spark-ignition engine or to the quantity of fuel injected in a Diesel engine. If the internal combustion engine is in overrun operation, then no output is desired. Therefore, fuel delivery to the internal combustion engine through carburetors, injection systems or the like is reduced or interrupted entirely.

In this manner, substantial fuel savings can be realized; on the other hand, the overrun mode is not without problems since the interruption of the fuel supply causes the internal combustion engine to cool down a certain amount, followed by higher pollutant emissions for a period of time following termination of the overrun mode of operation; and, it may also adversely affect the driving comfort when the engine switches from the overrun to the normal mode.

Another problem is that the engine speed behavior always has to be monitored closely, that is, the engine is not permitted to stall, not even if the supply of fuel is interrupted during overrunning while the engine is still cold. Thus, for example, a critical load may be encountered when, with the overrun cutoff mode enabled, the vehicle drives down hill with the engine still cold, that is, when the fuel supply is interrupted while the throttle valve is closed, and when the clutch is suddenly disengaged so that the internal combustion engine is no longer driven by the rotational movement of the wheels through the transmission. In such a case, there is the danger of the engine speed dropping so abruptly that the engine stalls before countermeasures can be taken.

Therefore, in a system providing for the interruption of the fuel supply with the engine overrunning, as disclosed in copending U.S. patent application entitled "Method for Operating an Apparatus for a Fuel Control System of an Internal Combustion Engine during Overrunning", having Ser. No. 410,669 and filed on Aug. 23, 1982, it is known to compare the actual engine speed with a predetermined, time-dependent characteristic of a resume speed and to interrupt the supply of fuel to the internal combustion engine only if the actual engine speed is above the characteristic of the resume speed. This makes it possible to sense the relevant operating state more accurately; the overrun cutoff mode is disabled if the engine speed drops below the desired resume-speed characteristic, and jerks caused by fuel-delivery resumptions can be avoided, thus adding to the driving comfort. Nevertheless, the known system for shutting off the fuel supply in the overrun mode of operation does not lend itself to universal use, nor is its response to all possible operating conditions sufficiently flexible. In particular, the vehicle behavior in the range of the resume speed may be problematic, with speed hunting being a possible occurrence. In addition, the vehicle may become subject to conditions under which it is desirable to inhibit the overrun cutoff function entirely.

SUMMARY OF THE INVENTION

By contrast, the apparatus of the invention affords the advantage of permitting a comprehensive response to practically all possible operating conditions of an internal combustion engine equipped with the overrun cutoff capability. In particular, a functional improvement is accomplished in the boundary range of dynamic resumption by causing a resumption and, at the same time, a latching function when the engine speed drops below the resume speed (dynamic range), thus inhibiting another cutoff function even in the event of another rise in engine speed or another regulation, that is, a lowering of the function characteristic of the resume speed over time. It is thereby possible to avoid undesired abrupt resume and cutoff torque changes which can be rather inconvenient in stop-and-go traffic, for example, when traffic lights require constant acceleration and deceleration of the vehicle.

Further, the invention affords the advantage of permitting a suppression of the overrun cutoff function by external switches or control units used in other vehicle components, and of increasing driving safety and/or driving comfort. When the fuel supply is cut off or resumed which is unavoidable in the range of the resume speed and corresponding fluctuations of the actual engine speed and with the overrun cutoff mode enabled, a more or less strong jerk will occur which is transmitted to the driving wheels. On slippery roads, for example, when tire grip is at a minimum, this may lead to critical driving situations. In this case, the invention permits full suppression of the overrun cutoff function. In this connection, the apparatus of the invention may also be used for overspeed protection in a charging-air pressure limiter.

BRIEF DESCRIPTION OF THE DRAWING

The invention will now be explained with reference to the drawing which shows a block diagram of the apparatus of the invention made up of discrete circuit components.

DESCRIPTION OF THE PREFERRED EMBODIMENTS OF THE INVENTION

The embodiments of the invention relate to suitable control units in a spark-ignition engine with fuel injection. It is to be understood that such a system is also suitable for use with any fuel metering apparatus provided the appropriate changes are made.

The output signal of an overrun cutoff stage generally identified by reference numera 10 in the drawing is applied to a connecting stage 11 whose other input receives specific fuel injection pulses from a fuel injection system generally identified by 12 and including at least one timing element. The duration of these pulses is dependent on the rate of air flow and the speed of the internal combustion engine. Reference numeral 13 identifies a speed sensor, 14 a circuit for sensing an idle-speed condition of the internal combustion engine, 15 a temperature transmitter, and 16 an air-flow sensor for sensing the mass of air or the quantity of air. These components are known per se in a fuel injection system and they are shown to place the overrun cutoff stage 10 into the overall system configuration. Therefore, connecting stage 11 is configured such that, in the presence of an overrun cutoff signal from overrun cutoff stage 10, it will inhibit the further transmission of fuel injection pulses generated by the fuel metering system or the injection system 12 to, for example, a final stage for the activation of fuel injection valves.

Overrun cutoff stage 10 determines substantially from the operating conditions "throttle valve closed" and speed n whether an overrun condition exists. The engine speed signal passes from speed sensor 13 via a diode 9 connected in series with a resistor 17, to a speed-signal converter stage 18. The converter stage 18 is in the form of a RC-network and includes a capacitor 19 and series resistors 20 and 21 which are adjustable with respect to a positive supply voltage $+U_B$. From connecting node 24, the output voltage, which is inversely proportional to the engine speed, passes to the negative (inverting) input of a first operational amplifier 25 via series resistors 22 and 23 which are connected to node 24. The idle-speed signal is supplied to the other input of the operational amplifier 25 via various voltage divider circuits in combination with an energy store (capacitor 26).

It will not be necessary to go into further details of the circuit; operational amplifier 25 and the various voltage dividers generating bias voltages are configured such that in the event of an overrun cutoff condition, a high-level signal occurs at the output 25*a* of operational amplifier 25. The high-level signal is applied via series resistors 27 and 28 to an external output connecting terminal means 29 providing the overrun cutoff information. The same high-level signal determining the overrun cutoff condition passes via diode 30 and a resistor 31 to a voltage divider made up of resistors 32, 33 and 34 and to the inverting (negative) input of a subsequent operational amplifier 35 whose low-level output signal then activates connecting stage 11 to effect a suppression of the fuel injection pulses.

Operational amplifier 25 is provided with positive feedback means including a diode 36 and a resistor 37 arranged in series therewith and connected to the positive input of the operational amplifier, thereby permitting a hysteresis effect to form in the range of the resume speed; however, this precludes realization of a dynamic locking function in the boundary range of resumption. Accordingly, the invention proposes to apply the positive potential, indicative of a low actual rotational speed, of capacitor 19 of speed-signal converter stage 18 directly to the other (inverting) input of operational amplifier 25; this positive potential indicative of low actual speed is applied to operational amplifier 25 via a series arrangement of a diode 38, which permits current flow in a positive direction, and a resistor 39. As a result, when the engine speed drops below the resume speed that causes the resumption of fuel delivery, a locking function ensues maintaining this condition, so that another fuel supply cutoff is prevented with the engine speed rising or with the resume speed being further regulated, the resume speed following a predetermined characteristic course over time.

In overrun cutoff stage 10, the first operational amplifier 25 evaluates the actual-value signals applied to it; whereas, on the second operational amplifier 35, essentially timing element 40, which belongs to the voltage divider made up of resistors 32, 33 and 34, together with capacitor 41 and the two shunt resisters 42 and 44 predetermine the characteristic of the resume speed which is compared with the processed actual speed characteristic applied to the other (noninverting) input of operational amplifier 35. In this arrangement, the relevant characteristic of the resume speed is essentially determined by another comparator circuit represented by block 47. This block acts on timing element 40 via diode 48 and processes information it receives from the various points of circuit 10.

The possibility exists to have the output block 29 which holds the overrun cutoff information followed by an indicating device 49 providing an optical or acoustical indication when an overrun cutoff condition exists. On the other hand, it is also possible to provide input information as indicated by arrows 46 applied to block 29 via a block 45. By suitable dimensioning, the overrun cutoff information output which then serves as an input can be used for the introduction and implementation of measures suppressing the overrun cutoff function entirely.

In this connection, switch arrangements actuable at the operator's discretion may be considered. These enable the vehicle operator to respond to specific situations himself and to inhibit the overrun cutoff mode; however, it is also possible to use the signals issued by other vehicle components such as air condition units, temperature indicators and the like to suppress the overrun cutoff function at block 29. From this result, intervention possibilities can be provided to improve the vehicle behavior, to increase driving safety, to introduce an overspeed protection system, to introduce a super-charger pressure limiter in turbo-chargers, and the like.

It is understood that the foregoing description is that of the preferred embodiments of the invention and that various changes and modifications may be made thereto without departing from the spirit and scope of the invention as defined in the appended claims.

What is claimed is:

1. Apparatus for controlling the overrun mode of operation of an internal combustion engine in dependence upon the instantaneous actual speed and a resume-speed threshold characteristic, the apparatus including a throttle flap sensor and further comprising:

speed comparator means for generating an overrun signal indicative of the presence of an overrun condition;

evaluation circuit means for determing a fuel cutoff signal or a fuel metering signal;

means responsive to said overrun signal for cutting off the metering of fuel to the engine during said overrun condition and responsive to said fuel metering signal for resuming the metering of fuel to the engine after said overrun condition has passed; and, disabling means dependent upon engine speed for disabling the overrun cutoff function in the resumed condition for a predetermined period of time after said overrun condition has passed, whereby undesired abrupt resume and cutoff changes in the torque developed by the engine are avoided.

2. The apparatus of claim 1, said comparator means comprising: an operational amplifier; and, speed signal converter means for generating an output signal indicative of actual engine speed, said output signal being fed directly to said operational amplifier thereby improving driving performance after said resumed condition occurs.

3. The apparatus of claim 2, said comparator means comprising a series circuit for conducting said output signal of said signal converter means to the inverting input of said operational amplifier, said series circuit including a diode for passing positive voltages and a resistor.

4. The apparatus of claim 3, comprising terminal means connected to said operational amplifier and having an output for providing information on the overrun mode of operation; and, circuit means connected to said last-mentioned output for generating input signals for preventing the generation of overrun cutoff signals for application to a follow-on stage of said terminal means.

5. The apparatus of claim 4, said disabling means comprising a switch arranged in the area of the driver for suppressing the overrun cutoff mode of operation.

6. Apparatus for controlling the overrun mode of operation of an internal combustion engine in dependence upon the instantaneous actual speed and a resume-speed threshold characteristic, the apparatus including a throttle flap sensor and further comprising:

speed comparator means for generating an overrun signal indicative of the presence of an overrun condition;

evaluation circuit means for determining a fuel cutoff signal or a fuel metering signal;

means responsive to said overrun signal for cutting off the metering of fuel to the engine during said overrun condition and responsive to said fuel metering signal for resuming the metering of fuel to the enging after said overrun condition has passed; and, disabling means arbitrarily actuable by the operator of the vehicle for disabling the overrun function in the resumed condition for a predetermined period of time after said overrun condition has passed, whereby undesired abrupt resume and cutoff changes in the torque developed by the engine are avoided.

7. The apparatus of claim 6, said comparator means comprising: an operational amplifier; and, speed signal converter means for generating an output signal indicative of actual engine speed, said output signal being fed directly to said operational amplifier thereby improving driving performance after said resumed condition occurs.

8. The apparatus of claim 7, said comparator means comprising a series circuit for conducting said output signal of said signal converter means to the inverting input of said operational amplifier, said series circuit including a diode for passing voltages and a resistor.

9. The apparatus of claim 8, comprising terminal means connected to said operational amplifier and having an output for providing information on the overrun mode of operation; and, circuit means connected to said last-mentioned output for generating input signals for preventing the generation of overrun cutoff signals for application to a follow-on stage of said terminal means.

10. The apparatus of claim 9, said disabling means comprising a switch arranged in the area of the driver for suppressing the overrun mode of operation.

11. Apparatus for controlling the overrun mode of operation of an internal combustion engine in dependence upon the instantaneous actual speed and a resume-speed threshold characteristic, the appartus including a throttle flap sensor and further comprising:

speed comparator means for generating an overrun signal indicative of the presence of an overrun condition;

evaluation circuit means for determining a fuel cutoff signal or a fuel metering signal;

means responsive to said overrun signal for cutting off the metering of fuel to the engine during said overrun condition and responsive to said fuel metering signal for resuming the metering of fuel to the engine after said overrun condition has passed; and, disabling means for disabling the overrun cutoff function in the resumed condition for a predetermined period of time after said overrun condition has passed, whereby undesired abrupt resume and cutoff changes in the torque developed by the engine are avoided.

* * * * *

UNITED STATES PATENT AND TRADEMARK OFFICE

CERTIFICATE OF CORRECTION

PATENT NO. : 4,572,126

DATED : February 25, 1986

INVENTOR(S) : Herbert Arnold et al

It is certified that error appears in the above-identified patent and that said Letters Patent is hereby corrected as shown below:

In column 2, line 59: delete "numera" and substitute -- numeral -- therefor.

In column 6, line 10: after the word "passing", add -- positive --.

In column 6, line 24: delete "appartus" and substitute -- apparatus -- therefor.

Signed and Sealed this

*Twenty-ninth* Day of *July 1986*

[SEAL]

*Attest:*

*Attesting Officer*

DONALD J. QUIGG

*Commissioner of Patents and Trademarks*